United States Patent [19]

Raymond

[11] Patent Number: 4,723,576

[45] Date of Patent: Feb. 9, 1988

[54] FLUID POWER CONTROL SYSTEM

[75] Inventor: Robert E. Raymond, Zanesville, Ohio

[73] Assignee: Fluidcircuit Technologies, Inc., Lancaster, Ohio

[21] Appl. No.: 747,940

[22] Filed: Jun. 24, 1985

[51] Int. Cl.[4] ..... F15B 13/02

[52] U.S. Cl. ..... 137/884; 137/596.15; 137/596.16

[58] Field of Search ..... 137/596.15, 596.16, 137/884

[56] References Cited

U.S. PATENT DOCUMENTS

| | | | |
|---|---|---|---|
| 3,976,098 | 8/1976 | Raymond | 137/884 |
| 4,011,887 | 3/1977 | Raymond | 137/880 |
| 4,359,064 | 11/1982 | Kimble | 137/884 X |

*Primary Examiner*—Gerald A. Michalsky
*Attorney, Agent, or Firm*—Francis T. Kremblas, Jr.

[57] ABSTRACT

A fluid power control system is disclosed which is characterized by a construction which provides for utilization of very basic fluid power flow elements and pilot signal elements to form a vast multitude of power flow control functions using a minimum number of standardized valving elements. The control system comprises a power flow manifold which serves to interconnect a plurality of pilot actuated power valving elements of a given power flow circuit arrangement which represents a multitude of potential circuit flow paths for switching and modulating requirements. The power flow manifold is provided with a plurality of internal pilot flow passages communicating with key power flow circuit junctions and pilot ports of the power flow valving elements. The pilot flow passages are arranged such that each outlet in a given pattern in a preselected face of the power flow manifold. In the preferred embodiment, one or more signal flow manifolds may be interchangeably mounted in stacked array to the face carrying the pilot outlet ports. Each signal flow manifold is associated with a given pilot flow subcircuit and pilot valving elements which are communicated to the power flow circuit via axially extending pilot flow channels commonly provided in the pilot flow manifolds to perform a variety of power flow control functions.

5 Claims, 10 Drawing Figures

FLUID POWER CONTROL SYSTEM

BACKGROUND

The fluid power field basically remains an industry committed to a design philosophy wedded to the principle of packaging basic fluid operative valving elements in separate or distinct housings to form either a relatively simple or a complex dedicated control valve function. Generally speaking, these "valves", as commonly referred to in the industry, are then interconnected to one another to form a fluid power control circuit by means of conventional piping or manifold techniques.

This philosophy dictates that such a valve design can only be accomplished economically by the mass production of a given dedicated "valve" type in a special housing or package to reduce manufacturing cost to some feasible level. The attendant costs of this type of philosophy include maintaining a vast inventory of hundreds of different "valves" in hundreds of different dedicated valve bodies or packages. This remains true even though it has long been realized that all such valving functions are accomplished by a relatively few basic fluid operative elements, such as spools, poppets and the like.

More recently, a trend toward valve element cartridges has gained some attention in the field, however, again these are merely packaged in the similar great multiplicity of separate and distinct housings to form an elementary valving function which must be interconnected, often in a special body or housing, with other "valves" to form the desired control system.

In my prior U.S. Pat. No. 4,011,887, I disclosed a novel manifold design which could be employed in cooperation with the more or less conventional dedicated "valves" to perform the interconnection function between such dedicated "valves" in a compact and economical manner. Also disclosed in this patent was a valve package system which includes the basic fluid operative elements such as spools, mounted within the manifold body and interconnected to form a complete control system for a given application. While this form of power control system was a significant and valid improvement for some applications compared to the prior art, and the manifold principles disclosed therein represent a drammatic improvement over the prior interconnection means, the disclosed control system did not represent sufficient flexibility in design philosophy to provide a more complete and satisfactory solution to the most pressing present needs of the fluid power industry.

The fluid power industry, unlike the modern electronic science, has not been able to solve the huge cost of manufacture by reducing the operative functions to their most elementary state and create a package which is both economical and sufficiently flexible to perform a multitude of required control functions utilizing a relatively few basic standardized parts.

The present invention is directed to this problem and provides a control system which may be "programmed" or commanded in response to an interchangeable pilot control module arrangement to perform a wide variety of fluid power control functions in a very compact and economical manner.

SUMMARY OF INVENTION

The present invention relates generally to fluid power control or valving functions and particularly to an improved control system in which basic power flow control elements can be quickly and simply programmed or directed to create a selected one of a multitude of potential circuit flow paths to meet various switching and modulating control requirements.

In one aspect of the present invention, a relatively few basic power flow valving elements are arranged and interconnected in a given circuit via a manifold which also provides pilot signal flow paths communicated to the necessary circuit junctions and pilot signal ports. The signal flow paths are designed to outlet in a given pattern, preferably on a given face of the power flow manifold.

In the preferred embodiment, signal flow circuits are provided in signal flow manifolds with connected preselected signal flow control elements to form a pilot or signal module. These signal flow manifolds are mounted to the power flow manifold in a manner to easily communicate with any of the signal flow paths in the power flow manifold. The signal flow manifolds include a plurality of axial signal channels extending through the manifold to permit flexible and selective communication between the given pilot signal elements and the power flow circuit to dictate the desired operation of the power flow elements.

In another aspect of the present invention, the design of the pilot manifold in cooperation with the power manifold provides for relative simplicity and ease of mounting the pilot manifolds. A center rod or post is provided which is threaded into the power flow manifold and axially disposed through a center core of the pilot flow manifold and secured thereto by a retaining nut. This permits easy alignment of the pilot flow outlet passages and axial signal channels so that a plurality of pilot manifold modules can be conveniently mounted in a compact stacked array.

In another preferred aspect of the present invention, additional axial channels may be provided in the core of the pilot manifold to permit intercommunication between pilot flow circuitry contained in separate pilot flow manifolds to provide more flexibility in circuit design and further simplify the number of standardized basic pilot signal elements required to provide a vast multitude of pilot signals and power flow control options.

OBJECTS

It is a primary object of the present invention to provide a fluid power control system which possesses the flexibility to perform a multitude of power flow control functions using a minimum number of basic standardized fluid operative control elements.

It is another object of the present invention to provide a control system of the type described which is provided with a removably mounted pilot signal manifold section which dictates the functional operation of the basic power flow control elements incorporated in a power control package.

It is another object of the present invention to provide a control system of the type described which lends itself to an overall reduction of manufacturing cost without limiting the complexity of control circuitry desired for a given application, and further which increase the control potential of the system compared to the prior methods and means.

It is a further object of the present invention to provide a fluid power control system of the type described which incorporates the advantages referred to herein and further represents an economical and practical vehicle to enhance fluid power control philosophy and circuit design in a drammatic fashion and permits such moderized fluid power control to more closely approach the rapid technological advances realized in the electronic science.

Further objects and advantages of the present invention will be apparent from the following description, reference being had to the accompanying drawings wherein preferred form of embodiment of the invention is clearly shown.

IN THE DRAWINGS

DETAILED DESCRIPTION

A preferred embodiment forming a fluid power control system constructed in accordance with the present invention is shown in FIGS. 1-4 and includes a power flow manifold, indicated generally at 20, to which a plurality of basic power flow valve element modules 22 are shown mounted on opposing faces of manifold 20. For purposes of the present invention, the modules 22 may be conventional valve elements of the spool or poppet type, in a cartridge style, or it may be a relatively simple dedicated conventional valve package. Preferably, however, the preferred embodiment employs a relatively simple spool or poppet element sized to match the power flow and pressure requirements of the designed system in a relatively simple conventional cartridge module form.

The power flow manifold 20 is of the type described in my issued U.S. Pat. No. 4,011,887 and is shown standing alone in the general representation thereof in FIG. 10. Circuit flow paths in the form of grooves, such as 92, are formed on the outer surface of a core 94 disposed within and provide a greater surface area as may be required for more complex interconnections and/or manufacturing convenience. In connection with drilled radial passages, such as 97, the necessary circuit interconnections between all valve function elements may be accomplished in a compact and economical fashion and yet provide as complex a circuit as necessary for almost all applications. The principles for creating power flow circuit paths are essentially the same as disclosed in my prior referred to patent, therefore, a detailed description is not necessary herein for understanding the present invention which represents an improved and more flexible control system which increases standardizing techniques and drammatically reduces manufacturing and inventory costs for providing a complete fluid power control system.

Figure 1:
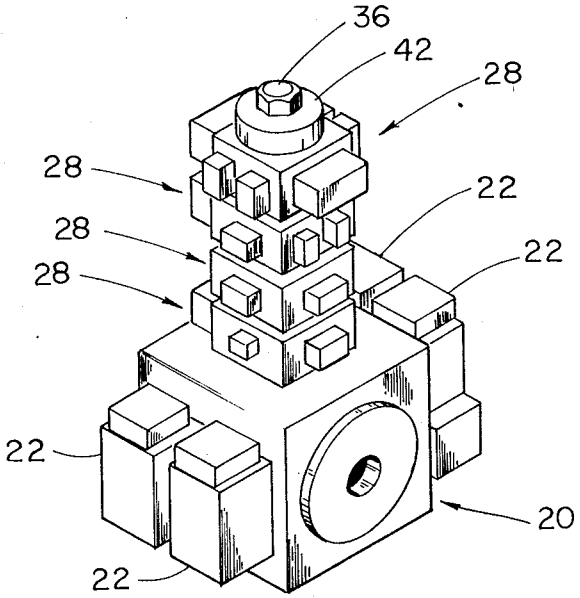
FIG. 1 is prespective view of a representive assembled fluid power control apparatus constructed in accordance with the present invention.
Figure 2:
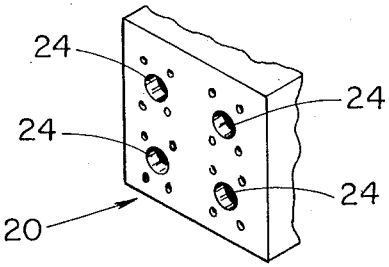
FIG. 2 is a partial perspective view of the bottom surface of the power flow manifold forming a portion of the present invention illustrating the main inlet and outlet ports for communication to external fluid operated elements.

As best seen in FIG. 2, inlet and outlet ports indicated at 24, serve to communicate the external fluid operative elements such as a piston rod actuator and the main power flow or supply pressure and tank to manifold 20.

The basic power flow element modules 22 are preferably operatively connected to a plurality of pilot flow control manifold modules indicated generally at 28. Pilot manifold modules 28 may comprise a manifold section 26 having one or more valving modules, such as 30, of a size adapted to the pilot or signal flow requirement. These valving modules 30 are arranged in a circuit which may include one or more typical fluid control elements, such as conventional spools, poppets, orifices, capacitors or accumulators or the like. To maximize the standardization of a minimum number of different basic elements, the pilot valve modules 30 are preferably designed to perform one or more relatively basic elementary valving or control functions which may be mounted on and interconnected via the pilot manifold sections 26 to form a particular pilot flow control sub-circuit. Preferably, such modules comprise a simple housing for a basic valving element. Although in some instances, two or more elements or functions may be provided, when its frequency of use justifies volume production or a particular control function requires its separate manufacture.

Figure 4:
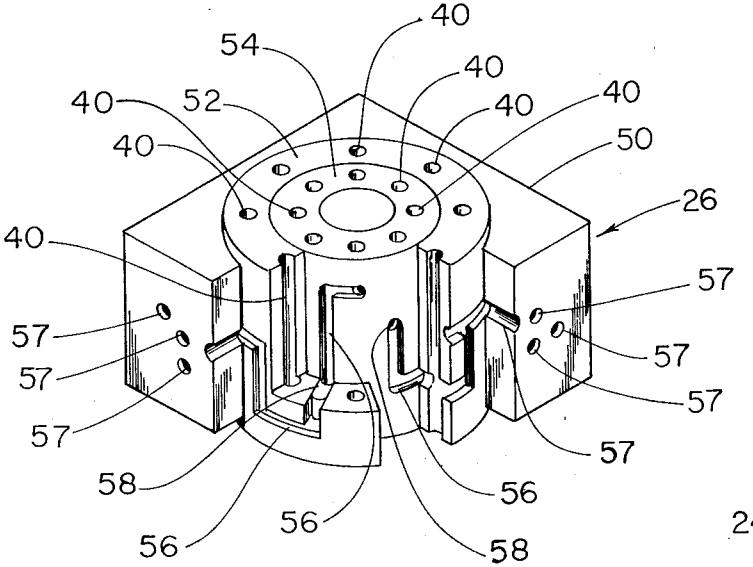
FIG. 4 is a perspective view partially cut-away to illustrate interior flow paths of a pilot flow manifold forming part of a pilot flow manifold module which is a part of the apparatus shown in the prededing Figures.
Figure 3:
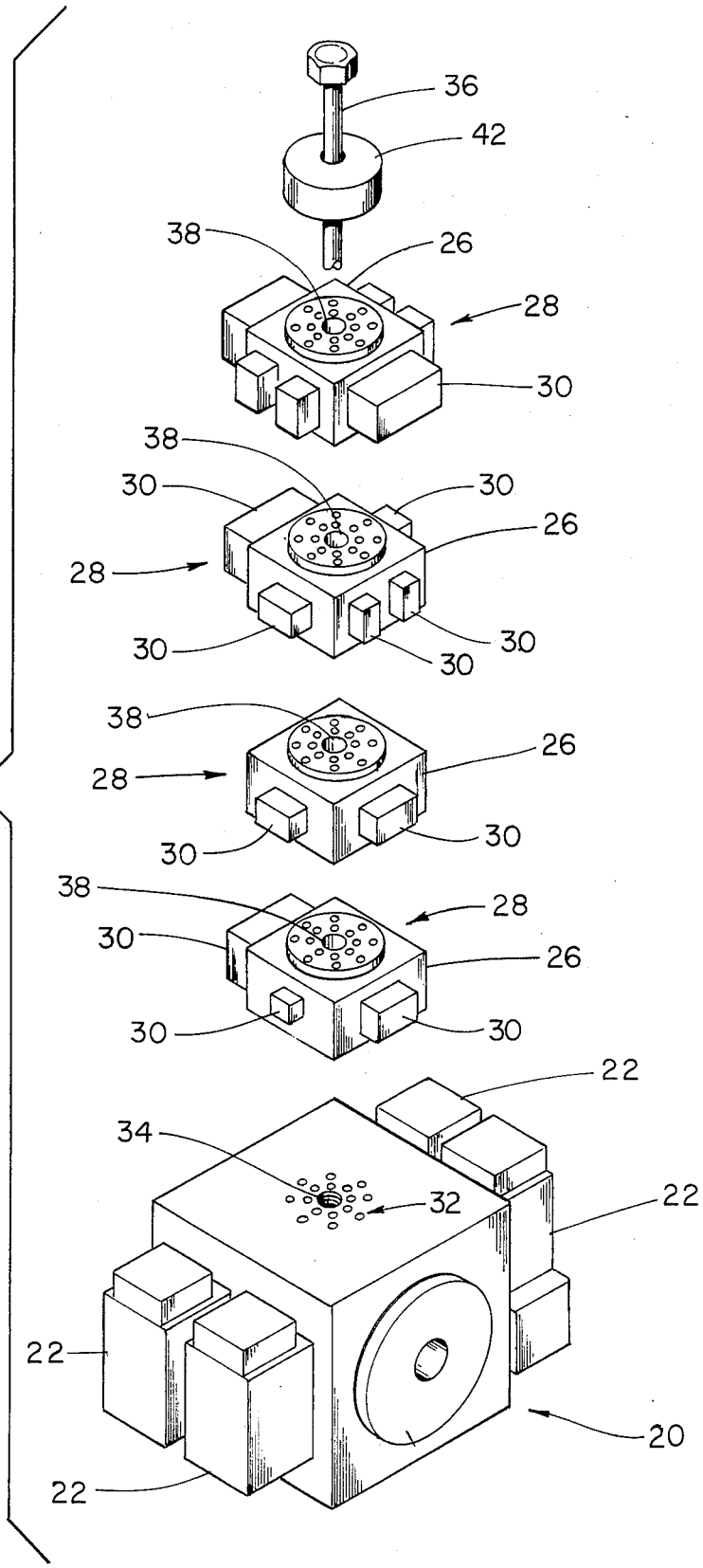
FIG. 3 is an exploded perspective view of the apparatus shown in FIG. 1.

In a similar manner to the power flow manifold 20, pilot manifold sections 26 include a receptacle 50 and inner cores 52 and 54 with grooves 56 and radial passages 58 connecting certain grooves 56 to form the circuit flow paths between valving function modules 30 mounted to the manifold 26 such as illustrated by the example shown in FIG. 4. The manifold section 26 and modules 30 then form a given pilot flow module package 28 which represents a predetermined pilot or signal sub-circuit.

The number of relatively low flow signal elements consistent with pilot control requirements of the larger power flow valving elements may be relatively limited utilizing the principles of the present invention and constitute a significant savings in manufacturing cost reflected by a large volume of a relatively few standardized parts.

For example, as few as seven or eight signal or pilot element valving functions may be employed relatively easily incorporating the concept of the present invention to provide the pilot control requirements for a standardized power flow housing and basic power flow elements interconnected in a generic circuit pattern to perform the control functions of a vast number of prior art dedicated "valves". The present invention provides the means to program or command this basic standardized power flow circuit package via the pilot or signal modules to perform a vast number of required system control functions. This is accomplished by a readily easily performed connection of one or more of the appropriate signal manifold sections forming a basic pilot sub-circuit to the power flow manifold.

Therefore, as compared to hundreds or thousands of dedicated prior art valves, each in a different package to perform a given control function, a very few standard power flow packages can be easily directed by relatively few signal flow modules to perform a similar number of control functions.

Figure 5:
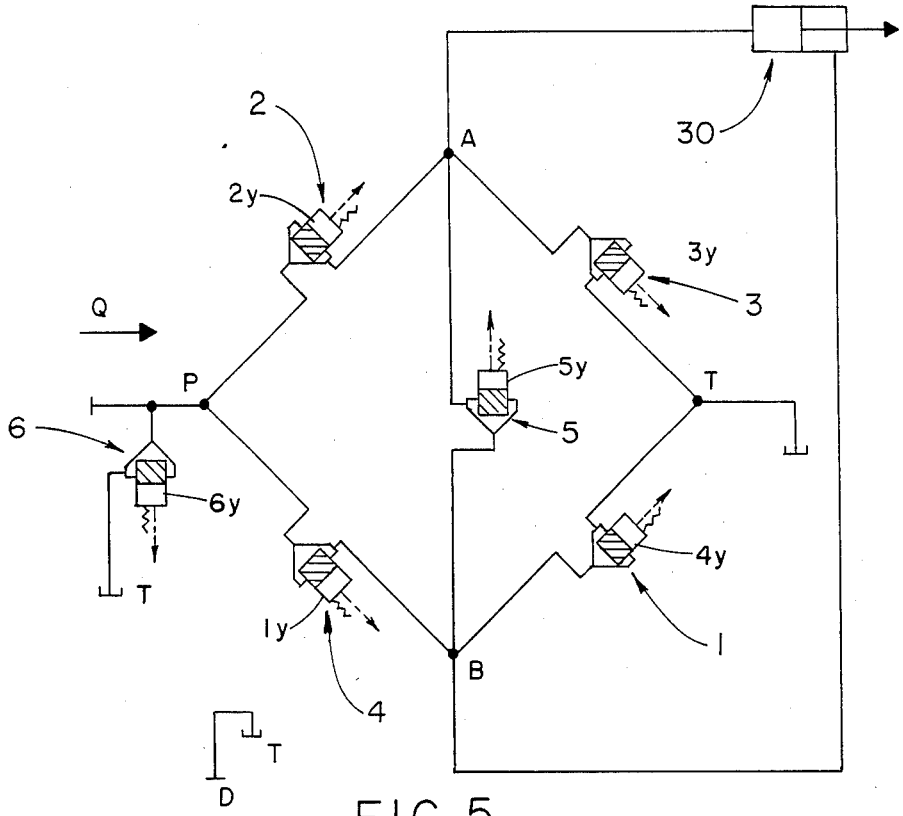
FIG. 5 is a diagrammatic view of a typical power flow circuit which may be employed in accordance with the present invention.

FIG. 5 represents a schematic view of a typical power flow circuit arrangement which can form a generic pattern for advantageous use in accordance with the present invention. The representation of the circuit in FIG. 5 may be referred to as a brdige flow arrangement and illustrates two-way poppet spool elements, indicated generally by numerals 1 through 6, which can be directed in such a way as to drive an actuator in a multitude of switching and modulating fashions in accordance with the present invention. These elements would be incorporated into power flow modules mounted to power manifold 20 such as represented at 22.

Elements 1 through 4 represent the main elements of a four-way bridge or a four-way valve function. Assuming for purposes of description, the system is conventionally connected to a hydraulic pump or power source and tank and to a typical cylinder and piston actuator indicated generally at 30. The actuator or piston rod can be driven out or turned back responsive to the opening of elements 2 and 4 or alternatively returned by opening elements 1 and 3.

Element 5 is disposed across the four-way bridge circuit to provide certain optional functions such as regenerative flow as will be explained in detail later herein. Element 6 functions as a relief valve to the main tank or reservoir indicated at T1.

In a conventional manner each of the power flow elements described in FIG. 5 through which the larger flow occurs are provided with a smaller pilot or signal flow pressure port which are diagrammatically indicated at 1Y, 2Y, 3Y, 4Y, 5Y and 6Y. The main junctions of the circuit shown are indicated at A, B, P and T. The letters P and T refer to the pressure line and vent or tank line respectively. The letters A and B are referenced to the pressure line to the actuator inlet port and the outlet flow from the actuator outlet respectively. Each of these junctions must be appropriately communicated to pilot flow passages in order to effect the desired opening, closing or modulation of the various power flow elements.

Figure 10:
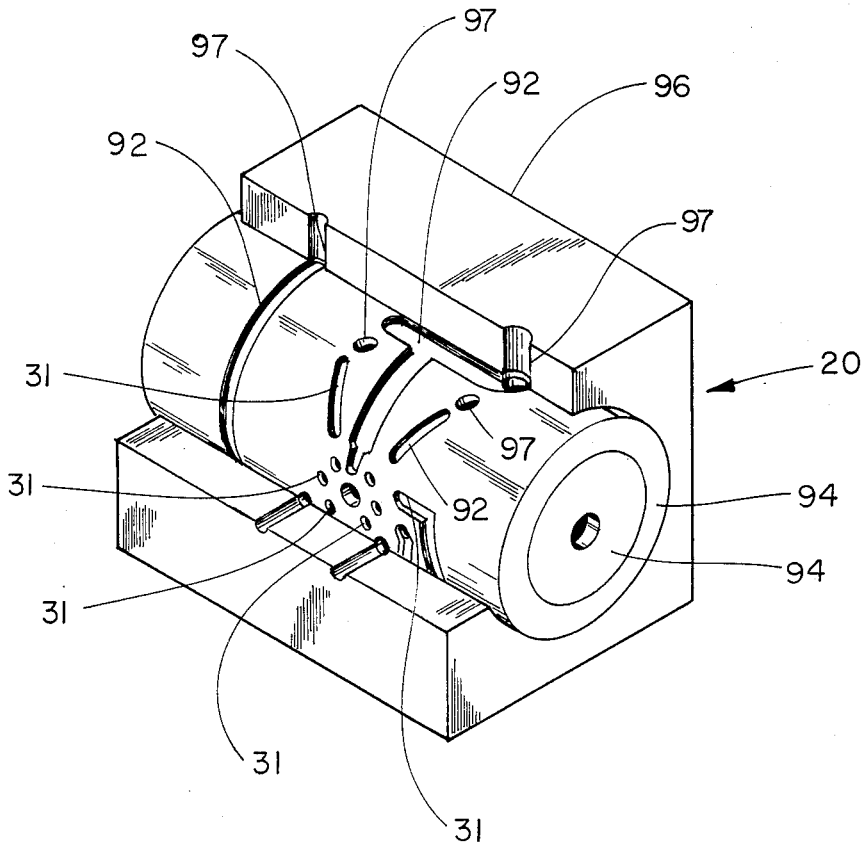
FIG. 10 is a partial perspective view of the power manifold section shown in FIG. 1 having a portion of the outer receptacle member cut away to merely illustrate formation of pilot flow paths converging to a common outer face of the receptacle member and is not necessarily a particular representative functioning circuit design.

These relatively low flow pilot signal passages are provided in the power flow manifold via appropriate grooves and radial passages as needed such as 31 in FIG. 10. Preferably, each of the pilot ports and the main circuit junctions described are communicated via such grooved paths and radial passages in the manifold 20 to outlet in a given face of manifold 20 in a given pattern represented by the signal passage outlet ports indicated generally at 32 in FIG. 1.

A central bore 34 is provided in manifold 20 and adapted to receive a threaded end of a connecting or assembly rod 36. This provides a simple, yet secure means for mounting the pilot or signal manifold sections 26 to one another and to the power flow manifold 20 via extending rod 36 through central bores 38 provided in each manifold section 26.

The pilot or signal passage outlets 32 provided on a face of manifold 20 are communicated to each pilot manifold section 26 via an identical pattern of axially extending pilot channels 40 provided within the walls of the center core of each pilot manifold section 26. Pilot channels 40 then form a pattern of signal channels extending through the center core of a respective manifold section 26 to communicate each of the pilot outlet ports 32 and their respective flow path connections in the power flow manifolds to the power flow circuit junctions and the necessary pilot ports in each power flow element.

The outlet side of the pilot channels 40 of a given manifold section 26 may be closed by conventional threaded plugs or by a conventional cover or plug plate as needed, such as 42 which is mounted in a similar fashion as each manifold 26 on center assembly rod 36.

Further, the inlets and outlets of each pilot passage 40 are conventionally provided with O-ring seals, not shown, to effectively seal the connections between each respective channel 40 when rod 36 is drawn tight to assemble the manifold sections 26 in operative position.

The use of the center connection rod 36 as described represents an economical and easy arrangement for adding or removing a manifold section module 30 to the stacked array as may be desired.

In addition to a pilot passage or channel 40 for a respective one of pilot outlet ports 32, the preferred embodiment includes a preselected number, for example 4 to 8, of pilot passages 40 which do not communicate with any of pilot outlet ports 32 on the face of power flow manifold section 20. Such internal pilot channels serve to interconnect all of the manifold sections 26 internally of the entire stacked manifold section array. These additional internal pilot channels permit selective intercommunication between any of the signal flow sub-circuits of each module 28 to permit their use in an orderly fashion. This feature enhances the pilot control options in a very flexible manner and contributes substantially to the reduction of the number of standaredized pilot sub-circuit manifolds and basic pilot elements required to create drammatically high number of control system circuits in an economical fashion.

This novel approach and manner of providing pilot channels extending through each signal section manifold in combination with the internal pilot channels also allows the circuitry of any of the signal section modules to be intercommunicated between them irrespective of their order in the stacked array. This feature contributes to further ease in adding or changing pilot section control functions when it is desired to modify the function of the power flow circuit as will be understood in describing the examples of pilot circuitry as shown in FIGS. 6–9.

As seen in FIG. 4, a typical signal manifold section 26 is illustrated and includes an outer rectangular receptacle member 50, an inner tubular member 52 and a center core member 54. Members 52 and 54 are shrunk fit into the opening of member 50 in a manner such as described in my U.S. Pat. No. 4,011,887.

The pilot signal channels 40 axially extend completely through the walls of tubular core member 52 and central core 54. In any given pilot manifold 26, the particular circuit design only communicates with the pilot channels 40 by means of a radial passage, such as 58, communicating a particular groove 56 in the circuit with either a given channel 40 or another grooved flow path 56 formed on the outer faces of core members 52 and 54. The remaining pilot channels 40 are isolated from any function or effect, but very importantly, are preserved for communication to another manifold section module 28 in the stacked array for any given control option.

As earlier pointed out, certain predetermined channels 40 which do not communicate with any of the pilot outlets 32 of power flow manifold 20, are also always present in any given stacked array of pilot flow modules 28 to provide a means for relatively simple intercommunication between given modules 28 for control function options.

Outlet ports 57 preferably in a standardized pattern are conveniently provided in the outer face of receptacle member 50 for mounting the valving functions modules 30 to manifold section 26 to complete the pilot circuit.

In accordance with the present invention and in the context of the linearly stacked array, it is important to point out that the pilot channels 40 are formed only within the wall of the center core member 54 or within the wall of a tubular core member 52 so they may solely carry the pilot flows without interferring with the surface areas which carry the grooves 56 of member 52 and 54. When one intentionally chooses to communicate with a desired channel 40 for control purposes, then the circuit pattern provides a radially drilled path, such as one of the passages 58, into the desired channel 40. This construction effectively provides a total ability to interconnect the signal sub-circuit of any manifold module section 28 with any of the pilot channels 40 extending continuously through each manifold module 28 which represent the signal flow to the power flow circuit junctions and power flow pilot ports. Further, this arrangement permits one to intercommunicate the circuitry of two or more signal section manifolds 26 as desired in an orderly and yet very flexible manner. In this fashion, conventional manufacturing techniques may be easily employed to construct the circuit patterns economically and the size of individual parts such as the housing receptacles and cores may be reduced to a minimum to save material costs and provide a compact design.

It should also be pointed out that the choice of pilot or signal sub-circuits may be varied depending upon several factors without departing from the spirit of the present invention. A great many pilot requirements for control of the larger power flow elements can be effectively met by a relatively few signal control functions in accordance with the present invention.

By way of example, only for descriptive purposes, FIGS. 6 through 10 illustrate typical examples of pilot control and power flow function options within the spirit of the present invention with reference to a generic basic power flow bridge circuit, shown in FIG. 5, which may be advantageously employed in connection with the present invention.

Figure 6:
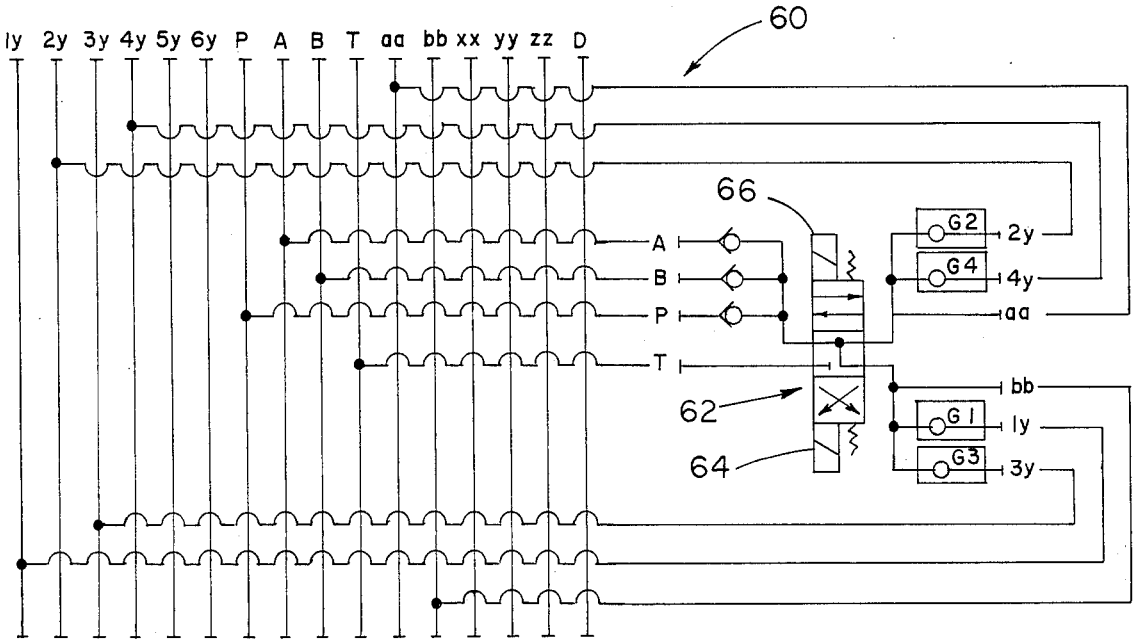
FIGS. 6 through 9 are diagrammatic view of illustrative pilot flow manifold module circuitry forming pilot sub-circuits which may be advantageously employed in accordance with the present invention and illustrating various pilot flow control options to direct the basic power flow elements to perform various control functions.

Referring to FIG. 6, a typical basic signal function sub-circuit provided in a manifold section module such as 28 is shown. The manifold section 26 of a pilot flow module such as represented at 28 would be mounted to manifold 20 in aligned and sealed relationship with respect to pilot outlets 32 as previously described and is represented in general appearance only in FIG. 2.

In the schematic view of FIG. 6, a solenoid actuated four-way switching circuit arrangement is shown with this pilot circuit indicated generally at 60. The axial extending pilot channels 40 connected to pilot outlet ports 32 of power flow manifold 20 are represented by the lines marked 1y through 6y and P, A, B and T. The lines, aa, bb, xx, yy, and zz represent an optional number of internal pilot channels 40 which are only communicated internally within the pilot manifold sections 26 and are not directly communicated to the power flow outlets 32 shown in FIG. 3. These pilot channel references remain the same for FIGS. 7–9 and relate to communicate with the pressure pilot ports 1y through 6y and circuit junctions A, B, P and T as shown in FIG. 5.

Four-way pilot function element 62 receives its pilot pressure from the connection to channel P which is communicated to the source of main pressure in the system at junction P in FIG. 5 and also from the connection to lines A and B, if at any time higher pressure is generated at the associated power flow valve elements. This arrangement provides that the manifold pilot module 28 for this four-way control function will always be communicated to the highest pressure in the system.

As shown in FIG. 6, the output of this four-way element 62 is then connected to the 1y, 2y, 3y and 4y pilot channels 40 in an appropriate fashion to cause either power flow elements 2 and 4 to open or elements 1 or 3 to open as directed by the logic commands of solenoids 64 and 66.

At the same time the pilot pressure for power elements 2 and 4 is also generated in pilot channel aa which makes that pressure value available to any other pilot manifold module 28 which may be added to the system for the same kind of logic present in the circuit of FIG. 6. In the similar manner pilot channel bb is connected to the four-way function. When power elements 2 and 4 are directed to open as the pressure is vented, then the pressure in channel aa is vented. When 1 and 3 are directed to be open or closed, the same pressure signal is present in internal channel bb. Therefore the logic for the four-way module 62 is present in pilot lines aa and bb for use anywhere in the signal manifold assembly for any appropriate use in connection with another signal manifold sub-circuit as desired.

It should also be pointed out that there may be instances wherein it is desired to close a given channel, such as 2y for example, in order to provide another signal manifold module 28 to perform that function. This may be readily acccomodated in the appropriate radial passage communicated to any pilot channel 40 which is provided with threaded capability for insertion of a threaded orifice element or a plug. For example, pilot channel 2y may be closed by plugging orifice G2 as seen in FIG. 6.

In a similar manner, G1, G3 and G4 indicate a threaded orifice capability wherein a threaded plug may be inserted into the radial path communicating with the particular channel 40 to close the existing flow path otherwise provided in a pilot manifold 26 as desired.

As shown in FIG. 6, a simple directional control function is provided wherein actuation of solenoid 64 vents power elements 2 and 4 causing them to open and holds 1 and 3 closed. Actuation of solenoid 66 vents power elements 1 and 3 and holds 2 and 4 closed with pilot pressure. In a de-energized state or center position, element 62 communicates pilot pressure to each of the pilot ports of power flow elements 1, 2, 3 and 4 which holds the elements closed. Therefore the four-way bridge, as shown in FIG. 5, may move the actuator rod in actuator 32 out and back according to the predetermined solenoid logic in signal manifold module representing sub-circuit 60. In this descriptive example, power flow elements 5 and 6 are not operative and would be blocked by an appropriate blocking plate operatively mounted to power flow manifold 20.

However, in order to add a relief valve function to the power flow to control pressure, power elements 1, 2, 3, 4 and 6, as seen in FIG. 5, would be made operational. The pilot channel designated 6y is communicated to an appropriate grooved path, not shown, forming a pilot flow path in power flow manifold 20 communicating with pilot port 6y of power element 6 and must be controlled. Additionally, the operative circuit junctions which apply must be communicated to an appropriate pilot manifold module. This may be accomplished by the pilot control circuit represented in FIG. 7.

Figure 7:
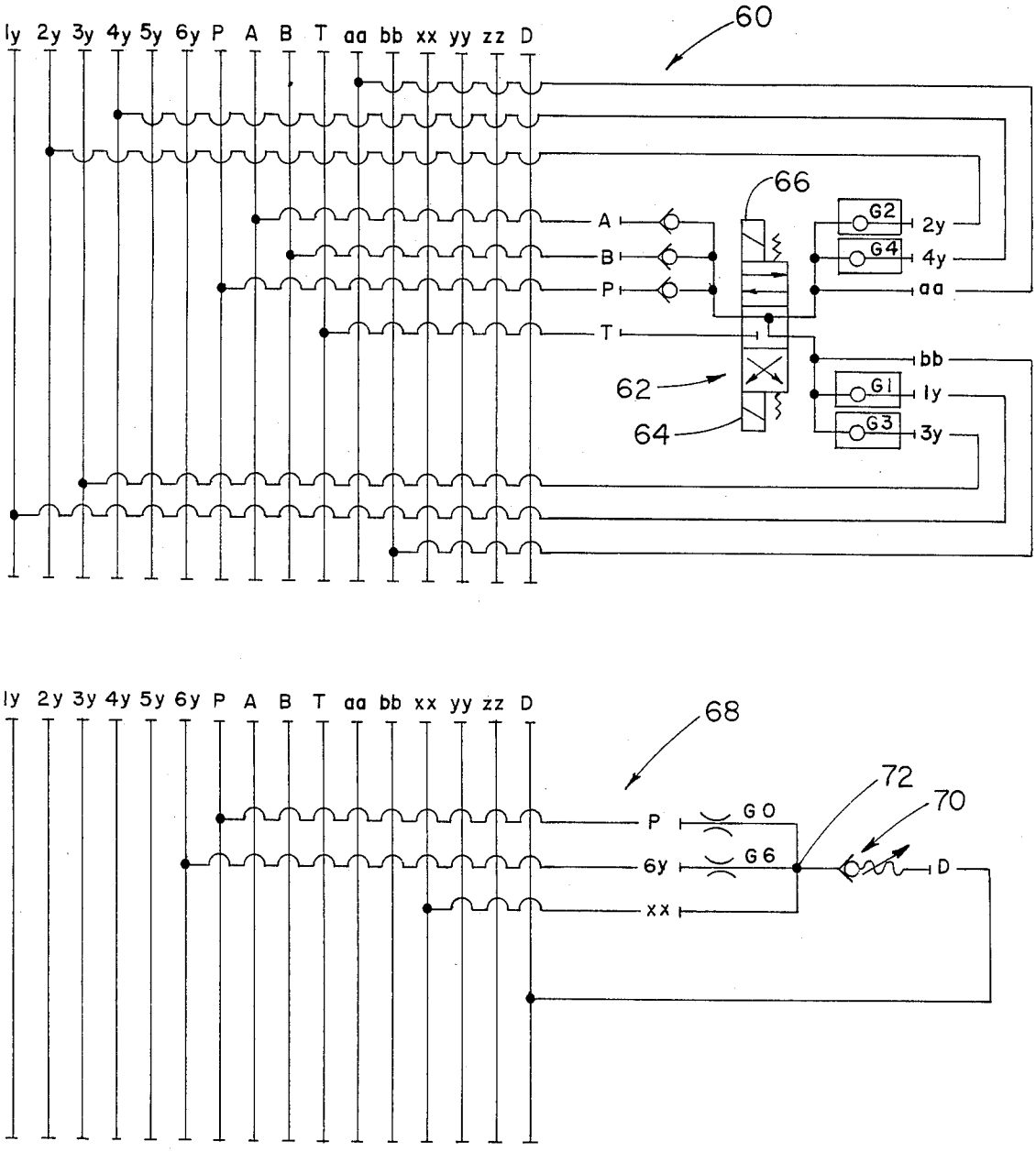

With reference to FIG. 7, a relief valve feature is added via another separate pilot flow module 28 which includes center core members 52 and 54 having the identical number and arrangement of axial bores forming the signal flow channels 40 as the first manifold module described with reference to FIG. 6. The added module would include appropriate grooves and radial passages to form the desired flow paths as represented in circuit 68 of FIG. 7. Now two pilot manifolds 28 are arranged in a stacked array with the pilot channels 40 aligned in sealed relationship to a respective outlet and inlet of channels 40 in each pilot manifold 26. The manifolds 26 are held in position by a center connecting rod, such as 36, in the same manner as earlier described herein.

As seen in FIG. 7, a signal or pilot sub-circuit indicated generally at 68 includes a pilot relief valve element 70 and its associated orifice controls, G0 and G6 are connected to the axial channels 40 designated P, 6y, xx and D. As shown, pressure is detected in the main pressure line through axial channel P through orifice G0 and back to the control point via channel 6y through a damping orifice G6.

Pilot valve function 70 is provided and may be a conventional poppet or spool type element which is spring loaded and set at a given pressure, for example one thousand psi.

As the pressure in the main pressure line builds to one thousand psi, signal element 70 opens and causes a pressure drop across orifice G0. This reflects the pressure drop across power flow element 6 against its bias spring and the element 6 begins to open in a modulating manner to control or by-pass excessive fluid to the main tank T in FIG. 5. In this manner, the maximum pressure or the operating pressure of the system is controlled as dictated by the pilot relief valve 70.

The relief valve function described in FIG. 7 operates in conjunction with the four-way directional control described in FIG. 6 as well as in addition to it.

As shown in FIG. 7, one has the option of communicating the pilot circuit junction 72 from the pressure sensing element 70 to a axial pilot channel designated xx. The axial pilot channel xx, as well as pilot channels aa and bb are internal pilot flow channels which do not communicate directly with power flow manifold 20 but provide a means to communicate a given pilot signal throughout the manifold module array as desired.

Therefore, the pilot pressure present at pilot junction 72 from the pilot sub-circuit 68 represented in FIG. 7 is operatively present through the entire array of pilot manifold modules 28 which may be added to the system for any optional future use.

The outlet flow from element 70 is returned to axial channel D which is a drain channel communicated to a separate circuit path connection provided in power flow manifold 20 represented as D in FIG. 5. In turn, this path is connected to the main tank, or reservoir T. D in FIG. 5 represents a separate flow path which is provided in an appropriate manner in the power flow manifold 20 which is one of the outlets in the outlet array 32, shown in FIG. 2.

Often a separate drain to tank is conventionally provided to eliminate undesirable back pressure effects in a pilot control circuit.

One may choose to add another control feature to the flow characteristics of the power flow circuit shown in FIG. 5. For example, a regeneration path from the rod side of the cylinder to the bore side. This control feature is often desirable to enable the rod to move faster during the advance stroke.

To accomplish this, power flow element 5 would be unplugged, as previously described, to be operative across the bridge power flow circuit between junctions A and B as shown in FIG. 5. Now the pressure pilot port 5y of power element 5 must be controlled in some logical manner to assure element 5 functions as desired.

Figure 8:
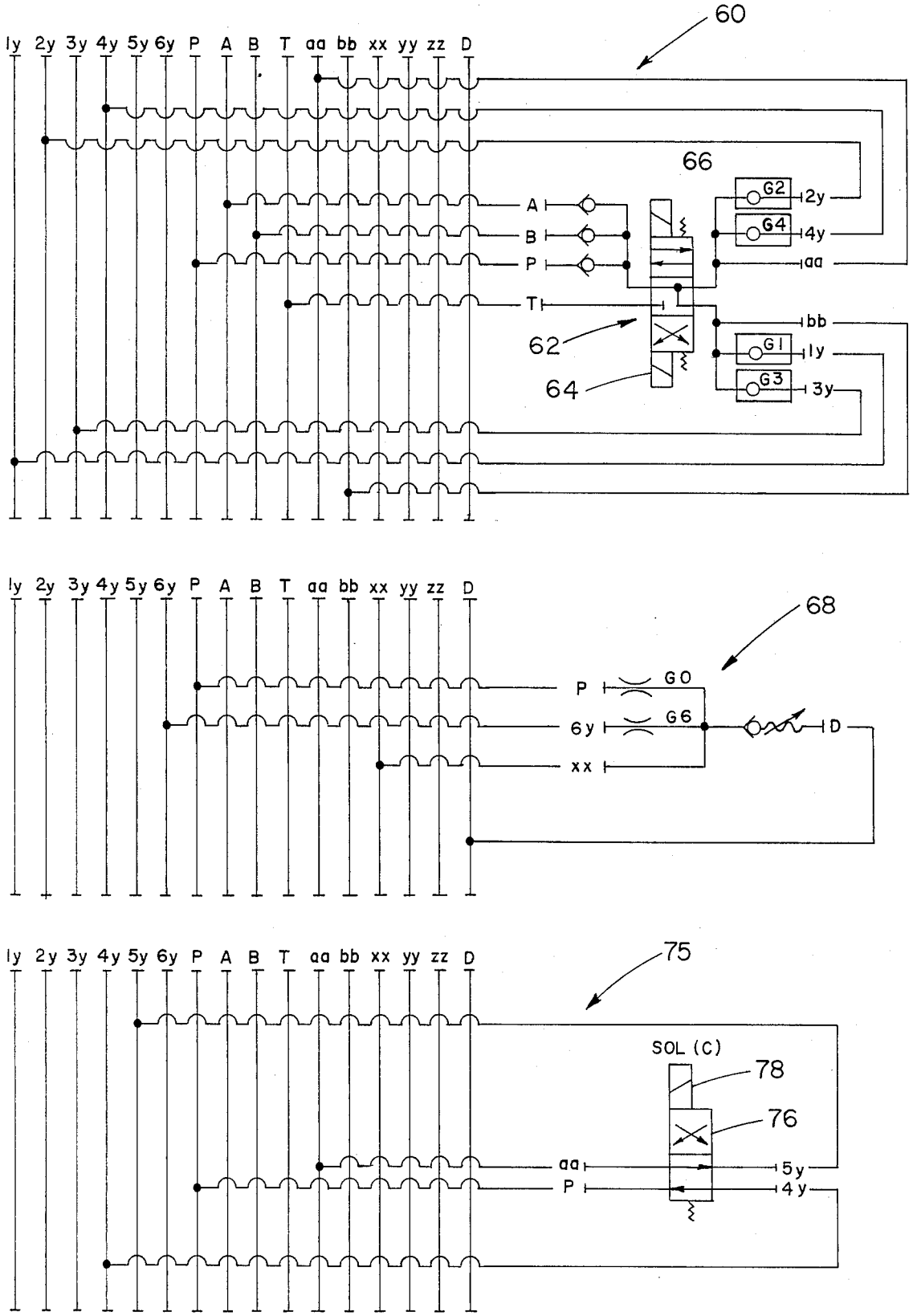

In accordance with the present invention, this is done in a relatively simple fashion by adding a third pilot flow module 28 to the array described above in the same manner to form the pilot control circuit represented in FIG. 8. In addition to the two pilot flow modules previously described in sub-circuits 62 and 68, a regeneration sub-circuit indicated at 75 is provided which includes a logic pilot valve element 76 which is actuated by a solenoid 78. The pilot sub-circuit 75 connects the pilot ports 4y and 5y of power element 4 and 5 respectively, via axial pilot channels designated 4y and 5y, to the element 76 for certain logic commands during regeneration.

To accomplish this function, the channel 4y in the first pilot manifold sub-circuit 62 must be cancelled. This may be easily accomplished by inserting a threaded plug in place of the orifice G4 in the appropriate radial passage which communicates with axial channel 4y in the manifold module described with reference to FIG. 6. This effectively isolates axial channel 4y from its original communication with the solenoid operated element 62 as shown in FIG. 6. Now the signal present in channel 4y will be controlled in a different manner. Channel 4y, like all the axial pilot channels 40, is communicated throughout all the pilot flow manifolds in the stacked array. Therefore, as earlier noted, it may be picked up in the regeneration manifold sub-circuit, indicated generally at 75, by providing an appropriate radial passage in the circuit pattern formed in the pilot manifold section represented by pilot subcircuit 75.

The pilot sub-circuit 75 is communicated to the internal pilot channel aa and the main pressure channel P to provide its logic function. Pilot channels 4y and 5y will be switching output as described herein. Channel aa also communicates with the four-way pilot elements 62 as shown in pilot sub-circuit 60.

In the position shown in sub-circuit 75 of FIG. 8, pilot channel aa communicates with the center position of the switching valve element represented at 76 at maximum pressure and which holds pressure at pilot port 5y to hold power element 5 closed. Of course, in this center position the main pressure in channel P will hold pressure at pilot port 4y to hold power element 4 closed and no control function will occur.

When the rod of actuator 30, FIG. 5, begins an advance stroke, the pressure in channel aa drops to a vented condition as dictated by the action of the four-way element 62 and pilot sub-circuit 60. Therefore the pressure to pilot port 5y drops and element 5 opens. But element 4 remains closed because the switching valve element 78 will not vent pilot port 4y until solenoid C is actuated.

Therefore the rod side of the cylinder of actuator 30 is now directed back to the bore side through power element 5 in a manner to cause regeneration flow. That is, the output flow from the actuator 30 will flow back to the input side in addition to the normal pump flow through open element 2. Now the rod will move faster by a given ratio. Generally this ratio is twice the normal flow from the pump depending on the ratio of the area of cylinder bore to the annular area of the actuator rod.

As the rod moves out faster during this regeneration mode, a point is reached at the end of the stroke where a return to the lower pump flow is desired. Now solenoid C in sub-circuit 75 is actuated to cause the 5y and 4y pilot ports to switch. Port 4y is then connected to channel aa which is vented. This now opens power element 4. At the same time pilot port 5y is connected to the main pressure via axial pilot channel P. This causes power element 5 to close which closes the regeneration path as viewed in FIG. 5 and opens the rod side of the actuator 30 directly to tank or reservoir T. With the rod side veneted to tank and the bore side being fed by the pump flow through element 2, the actuator rod then moves only at normal pump flow speed through element 2.

When the rod reaches the end of the stroke or encounters a resistance, the pressure would rise in the system. However, the system pressure is controlled by the relief valve function of the sub-circuit 68 of the second pilot module described herein. The pressure rise would be sensed and the maximum pressure held by power flow element 6 as previously described.

When solenoid C is de-energized for the return stroke, both pilot ports 4y and 5y are pressurized via the pressure signal in channels aa and P to cause elements 4 and 5 to close.

The directional control sub-circuit 60 dictates that power flow elements 1 and 3 open for normal return of the rod while holding 2 closed. Therefore on the return stroke, power elements 2, 4 and 5 are closed via the logic of the directional module circuit 60 and the regeneration module circuit 75 while 1 and 3 are opened via the commands of pilot circuit 60.

As shown in FIG. 8, with merely the addition of three relatively simple pilot or signal modules as shown, the six basic power flow elements of FIG. 5 are provided with four-way directional control, relief valve or pressure control for maximum pressure, and a regeneration flow capability superimposed therein to permit either a rapid advance stroke or normal speed advance stroke and normal speed for the return stroke.

Figure 9:
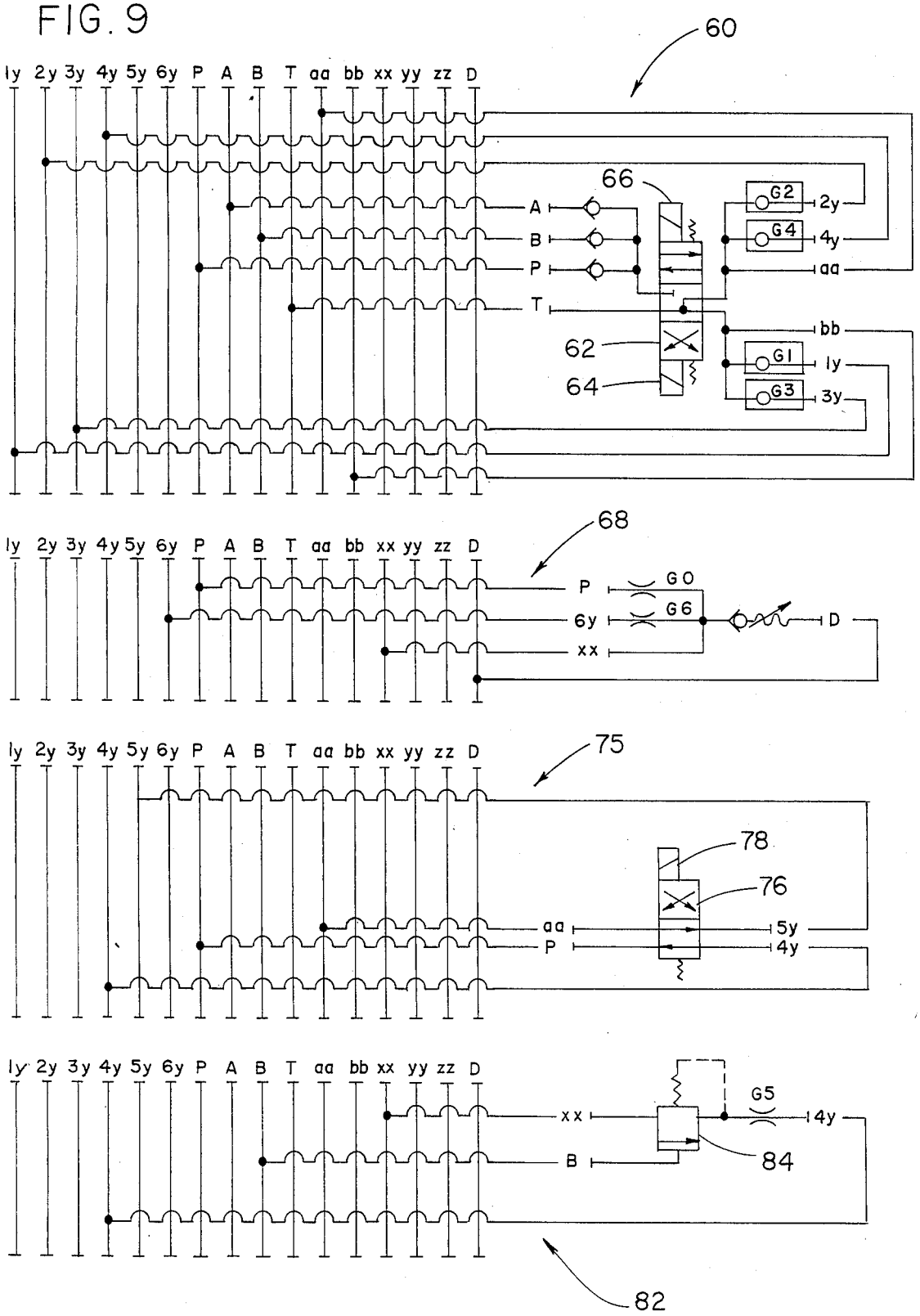

To further illustrate the drammatic flexibility of packaging and interconnecting a fluid power control system using very basic elements as described herein, a further control option is represented in FIG. 9 wherein an additional flow control characteristic is included by adding a fourth pilot control module 28 to the system. This control option relates to the end of the regeneration mode described herein and provides an adjustable feed rate which is pressure compensated so the feed rate does not change with the load.

As seen in FIG. 9, a pilot flow module having a pilot sub-circuit indicated generally at 82, is added to the pilot modules represented by the previously described pilot sub-circuits 60, 68 and 75. In pilot sub-circuit 82, the pressure on the rod side of actuator 30 is measured at junction B when the regeneration path is closed and the flow will be directed through power flow element 4. In this example, the basic power flow function module containing element 4 is modified by a conventional maximum limiting stem adjustment feature. This may be in the form of an adjustable stop which controls the degree of opening of valve element 4 when it is otherwise directed to open.

During the regeneration flow described, the rod advances rapidly. By energizing solenoid C, the regeneration path is closed and the pump flow goes to the bore side of actuator 30 and power flow element 4 is open. In this example, however, element 4 is limited by a stem adjustment to a particular value and therefore acts as an orifice resistance to the rod side of the actuator 30. As the rod moves, a pressure drop develops across element 4.

The pilot module sub-circuit 82, shown in FIG. 9, includes a spring-biased pressure sensing element 84 that is operatively communicated to power flow circuit junction B, in FIG. 5, via pilot channel B and to internal pilot channel xx. Channel xx is also connected with the relief valve module as seen in sub-circuit 68. A simple back pressure orifice G5 is provided in the pilot module circuit 82 for stability purposes to control the gain of the relief valve function.

Therefore element 84 senses the pressure at power flow junction B. Once the pressure at junction B in FIG. 5 reaches the predetermined setting of the spring force in element 84, such as 100 psi, for example, any attempt to rise above the 100 psi setting causes element 84 to open. The pressure in pilot channel xx will then be vented to a slightly lower value. If the pressure at junction B drops below 100 psi, then element 84 will close and the pressure in channel xx will rise very slightly.

Therefore all the power flow of the feed stroke is taken through power element 4 which is logically opened during the feed stroke by solenoid C through pilot channel aa.

Therefore the pilot module represented by pilot sub-circuit 82 provides a pressure compensated characteristic to the existing relief valve function represented by sub-circuit 68. The relief valve function described in FIG. 7 in conjunction with element 4, as modified in the example of FIG. 9, performs as a pressure compensated, by-pass flow regulator as the flow is fed out. By adjusting the stem limiting feature added to power element 4, one may vary the flow to a predetermined value and the feed rate will be accurately controlled.

If the maximum limiting stem adjustment is moved to a position wherein element 4 may only slightly open, the rod will creep out very slowly. The relief valve module will automatically adjust to pressure loading as required by detecting the pressure at power flow junction B via pilot channel B. The pressure at junction B, in this case, would be very low and modulated in accordance with the sub-circuit 82 as shown in FIG. 9.

During the return stroke, power element 4 must be closed. In sub-circuit 82, channel 4y is immediately pressurized during the return stroke which cancels the effect of modulating element 84 by communicating pressure to the back side of element 84 in addition to the spring force. This also closes communication with channel xx so that the relief valve sub-circuit 68 returns to its normal relief function. Therefore, the sub-circuit 82 will have no effect on the power flow circuit during the return stroke.

What is claimed is:

1. In an improved fluid power control system comprising a plurality of power flow valve elements, each provided with pilot ports, said power flow valve elements communicated to one another in a predetermined power flow circuit formed in a power flow manifold section, said power flow manifold section provided with at least one cylindrically shaped core member mounted in an interferring fit within an opening of a receptacle member; discrete fluid paths formed on at least one of the adjoining, interferringly fit surfaces of said members in the form of grooves and fluid passages communicating fluid between said core member and said receptacle member in the form of radial bores; the improvement comprising a plurality of certain of said discrete fluid paths forming pilot flow passages communicating certain circuit junctions of said power flow circuit and the pilot ports of said power flow elements to individual outlet ports arranged in a preselected pattern on a face of said power flow manifold section; at least one pilot flow manifold section mounted on said power flow manifold section and including at least one pilot flow valve element mounted on said pilot flow mainfold section; said pilot flow manifold section comprising at least one cylindrical pilot core member concentrically mounted in an interferring fit in an opening in an outer pilot receptacle member, said pilot core member provided with a plurality of bores forming pilot flow signal channels extending parallel to one another in an axial direction completely through said member to inlet and outlet in opposing faces of said member, at least certain of said inlets being aligned in sealed relationship to a respective one of said outlet ports of said pilot flow passages in said power flow manifold section, at least one of the interferring fit surfaces between said core member and said receptacle member including a plurality of grooves forming discrete fluid paths, radial passages formed in said receptacle member and said core member interconnecting said grooves and said pilot flow valve element with certain of said axially extending pilot flow signal channels to form a predetermined pilot flow control circuit for influencing the function of preselected power flow elements in said power flow circuit formed in said power manifold section.

2. The control system defined in claim 1 wherein a plurality of said pilot flow manifolds are mounted in abutting relationship to one another having said pilot flow signal channels of each of said pilot flow manifolds in sealed axially aligned relationship with one another; and wherein certain of said aligned signal channels are not directly communicated to said individual outlet ports arranged in said preselected pattern on a face of said power flow manifold but are communicated with at least two pilot flow control circuits formed in separate pilot flow manifolds.

3. The control system defined in claim 1 wherein said cylindrical pilot core member includes a plurality of cylicdrical tubular members concentrically arranged within one another with an outer surface of an inwardly disposed member being fixed in an interferringly fit to form a sealed relationship with a inner cylindrical surface of the adjacent cylindrical member; a plurality of grooves formed in at least one of the adjacent, sealed cylindrical surfaces of each of said concentrically arranged cylindrical members; and selected radial passages in said receptacle member and said tubular members interconnecting said grooves and said pilot flow valve element with certain of said axially extending pilot flow signal channels to form a predetermined pilot flow control circuit communicating with said power flow circuit of said power manifold section.

4. In a fluid power control system having a predetermined power flow circuit formed in a power flow manifold section interconnecting a plurality of predetermined power flow valve elements adapted to be programmed to provide variable power flow control characteristics; the combination of at least one predetermined pilot flow module including at least one preselected pilot flow valving element operatively connected for performing a preselected pilot control function, said pilot flow module comprising a pilot flow mainfold section having at least one cylindrical member forming a core mounted in an opening of an outer receptacle member with the outer peripheral surfaces of said cylindrical member and the inner surface of said opening in the receptacle member being sealed in an interferring fit relationship with each other, a plurality of grooves formed on at least one of said interferringly fit, sealed surfaces of said members and radial passages communicating with said grooves to form a circuit having discrete fluid paths, and a plurality of parallel, axially extending passages formed wholly within the walls of said core and having their inlets and outlets in opposing parallel end surfaces of said core to form a pluralilty of pilot flow signal channels; a plurality of signal flow passages formed in said power flow manifold section communication predetermined circuit junctions of said power flow circuit and pilot ports associated with each of said power flow valve elements to a plurality of pilot flow passage outlets arranged in a predetermined pattern in a preselected face of said power manifold, and wherein said pilot manifold section of said pilot flow module is mounted to said preselected face of said power flow manifold with at least certain of said inlets of said pilot flow signal channels being in sealed relationship with a respective one of said pilot flow passage outlets.

5. An improved fluid power control system comprising in combination; a plurality of flow control modules, each including at least one core member having a cylindrical outer wall concentrically arranged in a cylindrical opening in an outer receptacle member in an interferring fit to form a fixed, sealed relationship between the adjoining surfaces of said core and receptacle members, a plurality of grooves formed in at least one of said adjoining surfaces to form discrete fluid paths in axial and circumferential directions and radially directed passages formed in said members to intercommunicate said fluid paths with at least one fluid flow valving element connected to said receptacle member to form a predetermined fluid control circuit, and a centrally disposed, axially extending hole provided in said core member; said flow control modules being arranged in axially aligned, releasably fixed, abutting relationship to one another by a tie rod means extending through said centrally disposed axial extending hole in the core member of each of said modules, said core member of each of said modules provided with a plurality of parallel, axially extending bores formed wholly within the cylindrical wall of said core member, each of said axially extending bores terminating in an inlet outlet formed in opposing axially spaced end surfaces of said core member to form independent flow channels which are aligned to communicate with a respective one of the flow channels formed in adjacently disposed flow control modules; and selected radial passages formed in the core members of at least two of said flow control modules to communicate with at least certain of said flow channels for selective intercommunication of fluid between the fluid control modules.

* * * * *